US006321752B1

(12) United States Patent
Spottiswoode

(10) Patent No.: US 6,321,752 B1
(45) Date of Patent: Nov. 27, 2001

(54) MOUTHGUARD WITH INSIGNIA

(76) Inventor: Richard Spottiswoode, 2 Queen Street, Auckland (NZ)

( * ) Notice: Subject to any disclaimer, the term of this patent is extended or adjusted under 35 U.S.C. 154(b) by 0 days.

(21) Appl. No.: 09/463,305

(22) PCT Filed: Jul. 22, 1998

(86) PCT No.: PCT/NZ98/00109

§ 371 Date: Mar. 15, 2000

§ 102(e) Date: Mar. 15, 2000

(87) PCT Pub. No.: WO99/04722

PCT Pub. Date: Feb. 4, 1999

(30) Foreign Application Priority Data

Jul. 23, 1997 (NZ) ..... 328403

(51) Int. Cl.[7] ..... A61C 5/14
(52) U.S. Cl. ..... 128/859; 128/861
(58) Field of Search ..... 128/846, 848, 128/859–862; 602/902

(56) References Cited

U.S. PATENT DOCUMENTS

| | | | |
|---|---|---|---|
| 4,114,614 | 9/1978 | Kesling . | |
| 4,765,324 | 8/1988 | Lake, Jr. . | |
| 5,031,638 | 7/1991 | Castaldi . | |
| 5,234,005 * | 8/1993 | Kittelsen | 128/859 |
| 5,566,684 | 10/1996 | Wagner . | |
| 5,816,255 * | 10/1998 | Fishman | 128/862 |

FOREIGN PATENT DOCUMENTS

| | | |
|---|---|---|
| 131357 | 9/1997 | (AU) . |
| 0 265 771 | 5/1988 | (EP) . |
| 2 230 016 | 10/1990 | (GB) . |
| 2 285 981 | 8/1995 | (GB) . |

OTHER PUBLICATIONS

Dialog(R) File 610: Business Wire, Access No. 0645169, BW0104, "Space Maintainers Lab: New all–sports mouthguard called Intact keeps your teeth intact while you enjoy sports", Nov. 14, 1996, lines 42–43.
Andrew Walker, "Dentist's Mouthful for Scots", The Mirror, Mirror Group Ltd., Jun. 3, 1998, p. 8, lines 3–4 and 11–12.

* cited by examiner

*Primary Examiner*—Michael A. Brown
(74) *Attorney, Agent, or Firm*—Young & Thompson

(57) ABSTRACT

A mouthguard (10) is made from a sheet of copolyester, of about 5 mm in thickness, and has insiginia (11) observable on its front portion (13). The insignia is provided by an indentation (11) formed in the outside face (13) of the front of the mouthguard (10). The indentation (11) is formed by applying a stencil in a predetermined shape to the desired place on the mouthguard (10) when the mouthguard (10) is pliant. The indentation (11) is at least partially filled with a material of contrasting color (12).

5 Claims, 1 Drawing Sheet

MOUTHGUARD WITH INSIGNIA

FIELD OF THE INVENTION

The invention relates generally to the area of protective equipment for sports people and the like and more particularly to mouthguards.

OBJECT

It is an object of this invention to provide a mouthguard adapted to display insignia when worn, and/or a method of applying advertising to mouthguards, or at least one that provides the public with a useful choice.

STATEMENT OF INVENTION

In one aspect the invention provides a mouthguard adapted to display insignia when worn, said mouthguard having a front portion which will normally be visible when the mouthguard is worn, the front portion having an outside facing away from the wearer's mouth and an inside facing towards the interior of the wearer's mouth, wherein insignia is provided at least on the front of the mouthguard and is of a contrasting colour to the colour of the mouthguard.

Preferably the insignia is a logo, word, trade mark or the like, although other information may be provided.

Preferably the insignia is provided on or in the inside of the front portion of the mouthguard, or is embedded in the front portion of the mouthguard.

Preferably the insignia is provided on or in the outside of the front of the mouthguard.

Preferably the insignia is located in a recess in the front portion of the mouthguard.

Preferably the mouthguard is formed from a copolyester material.

In another aspect the invention provides a method for applying insignia to mouthguards comprising the steps of:

a) forming a parent piece of thermoplastic of a first colour into a mouthguard;

b) heating said mouthguard;

c) and either before or after forming the mouthguard applying an insignia to an, in situ, observable face of the mouthguard, said insignia being formed of a material of a contrasting colour to the parent piece.

Preferably the insignia is stenciled onto the observable face of the mouthguard.

Preferably the insignia is applied to the observable face by creating an indentation in the parent piece of material and at least partially filling the indentation with a material of a contrasting colour to the parent piece.

Preferably the indentation is formed on or in the inside of the front portion of the mouthguard, or is embedded in the front portion of the mouthguard.

Preferably the indentation is formed on or in the outside of the front of the mouthguard.

Preferably the indentation may be formed in the inside of the front of the mouthguard, or to the outside of the front of the mouthguard. It is preferable to form the indentation in the outside of the front of the mouthguard where a darker background material is used than the material that will fill the indentation.

Preferably, the thermoplastic used to form the mouthguard is a co-polyester.

Preferably, the contrasting material is chosen from the group comprising thermoplastic, gels, and paints that are non toxic if ingested and durable such that they will not wear away or chip off during use.

In another aspect the invention may broadly be said to comprise in a mouthguard adapted to display insignia when worn, said insignia being a contrasting colour to the colour of the mouthguard.

In referring to the colour of the material or other colour of the insignia the term "colour" is intended to encompass any colour or shading including black; white, grey, pastel as well as clear or transparent, translucent or opaque materials.

Preferably, the insignia is applied to the mouthguard by creating an indentation in the material used to form the mouthguard before or after the mouthguard is formed and at least partially filling the indentation with a material of a colour contrasting to the moutguard.

Preferably the indentation may be formed in the inside of the front of the mouthguard, or to the outside of the front of the mouthguard. It is preferable to form the indentation in the outside of the front of the mouthguard where a darker background material is used than the material that will fill the indentation.

Preferably, the mouthguard is formed from a copolyester material.

Preferably the indentation is formed by applying a stencil to the mouthguard while the mouthguard is pliant, for example after heating.

Preferably, the contrasting material is chosen from the group comprising thermoplastic, gels, and paints that are non toxic if ingested and durable such that they will not wear away or chip off during use.

BRIEF DESCRIPTION OF THE DRAWINGS

The following is a description of a preferred embodiment of the invention given by way of example only and with reference to the drawings in which.

PREFERRED EMBODIMENT

Figure 2:
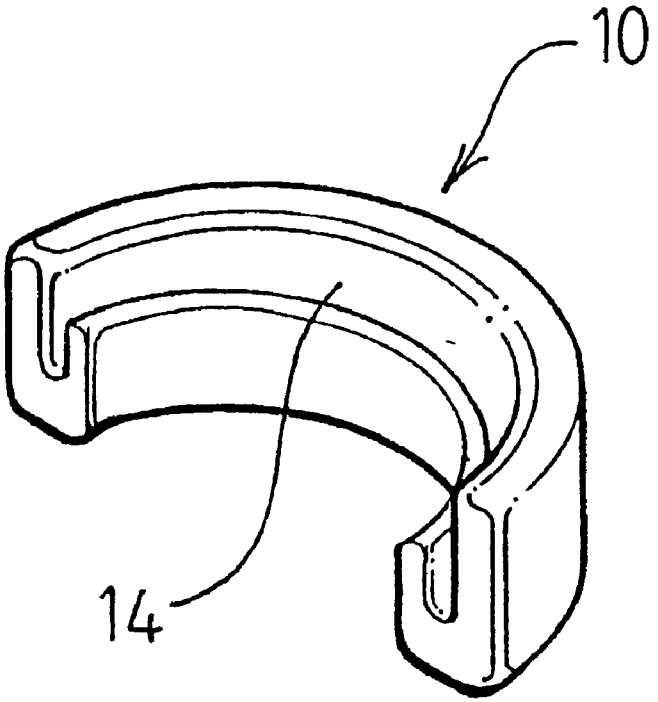
FIG. 2: shows a perspective view of the invention from the rear.
Figure 1:
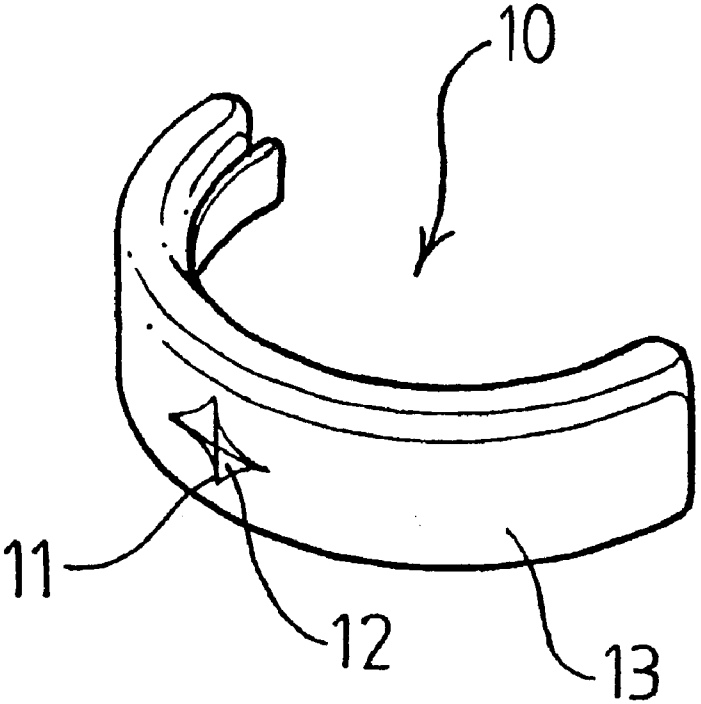
FIG. 1: shows a perspective view of the invention from the front.

A mouthguard 10 is made from a sheet of copolyester, preferably up to about 5 mm in thickness. The copolyester is readily available in many different colours. The mouthguard 10 may be fitted to the user by a dentist or the user may fit the mouthguard 10 themselves by heating, the mouthguard 10 for example in a cup of hot water and then placing it in their mouth. The material is such that the as it cools it will form to shape of the users teeth and mouth.

An indentation 11 is formed in the front of the mouthguard 10 on in situ observable face. The indentation 11 is formed in the outside face 13 of the front of the mouthguard 10 but in some circumstances it may be necessary or desirable to form the indentation 11 in the inside face 14 of the front of the mouthguard 10. The indentation 11 is formed by applying a stencil in a predetermined shape to the desired place on the mouthguard 10 when the mouthguard 10 is pliant. The mouthguard 10 may be made pliant by heating it up. The stencil is removed and as the mouthguard 10 cools down the indentation 11 sets in place.

The indentation 11 is at least partially filled with a material of contrasting colour 12. The contrasting material 12 may be the same material as the mouthguard 10 but cut to fit within the indentation 11 or some other suitable material such as a gel that will set, or a paint.

The indentation 11 may be in the shape of a sponsor's logo for example. The colour of the contrasting material 12 used to fill the indentation 11 in the mouthguard ensures that the logo is visible against the colour of the mouthguard 10.

Alternatively, in some embodiments it may be desirable to provide the indentation 11 before the mouthguard 10 is formed (ie while the material is still in sheet form) or before the mouthguard 10 is fitted to a particular user. An example of when this would be desirable is when it is desired to produce a number of mouthguards carrying the same pattern or logo.

Variations

Although I have referred to the use of copolyester as the desired material, it will be clear that a number of other thermoplastics or other materials could be used to form the mouthguard.

Although I have referred to forming an indentation and at least partially filling the indentation with a contrasting material to create the insignia, it will be apparent that the insignia could be applied by a number of other processes for example, the insignia could be supplied as a transfer or adhered to the, in situ, observable face of the mouthguard or otherwise printed on or stamped into the observable face.

In some cases the material could be provided as a sandwich with the insignia printed or formed on an inner face of a first layer of the sandwich and covered by a second layer of the sandwich so that at least one of the layers is transparent or translucent enough for the insignia to be visible through the layer. Such a sandwich construction can be produced in indefinite lengths (with the insignia provided at intervals) then cut to appropriate lengths and formed into mouthguards by bending or moulding as required.

It will be appreciated that a variety of changes may be made to the forgoing without departing from the scope of this invention as set forth in the claims.

What is claimed is:

1. A mouthguard adapted to display insignia when worn, said mouthguard having a front portion which will normally be visible when the mouthguard is worn, the front portion having an outside facing away from the wearer's mouth and an inside facing towards the interior of the wearer's mouth, wherein insignia is located in a recess in the front of the mouthguard and is of a contrasting colour to the colour of the mouthguard.

2. A mouthguard as claimed in claim 1, wherein the mouthguard is formed from a copolyester material.

3. A method for applying insignia to mouthguards comprising the steps of:

a) forming a parent piece of thermoplastic of a first colour into a mouthguard;

b) heating said mouthguard;

c) and either before or after forming the mouthguard applying an insignia to an, in situ, observable face of the mouthguard, by creating an indentation in the parent piece of material and at least partially filling the indentation with a material of a contrasting colour to the parent piece.

4. A method as claimed in claim 3, wherein the indentation is formed on or in the inside of the front portion of the mouthguard, or is embedded in the front portion of the mouthguard.

5. A method as claimed in claim 3, wherein the indentation is formed on or in the outside of the front of the mouthguard.

* * * * *